US008763797B2

(12) United States Patent
Guillon et al.

(10) Patent No.: US 8,763,797 B2
(45) Date of Patent: Jul. 1, 2014

(54) CLOSED TUBULAR CONTAINER COMPRISING A COMPENSATION DEVICE FOR THE PACKAGING OF TABLETS

(75) Inventors: Bruno Guillon, Paris (FR); Valere Logel, Levallois Perret (FR)

(73) Assignee: Clariant Production (France) SAS, Trosly Breuil (FR)

( * ) Notice: Subject to any disclaimer, the term of this patent is extended or adjusted under 35 U.S.C. 154(b) by 305 days.

(21) Appl. No.: 12/053,022

(22) Filed: Mar. 21, 2008

(65) Prior Publication Data

US 2010/0252458 A1 Oct. 7, 2010

(51) Int. Cl.
*B65D 81/26* (2006.01)
*F17C 11/00* (2006.01)

(52) U.S. Cl.
USPC ..... 206/204; 206/528; 206/540

(58) Field of Classification Search
USPC ..... 206/204, 528, 538, 340, 804, 817, 535; 215/5, 50, 52, 391; 221/67, 68, 208; 220/800–806
See application file for complete search history.

(56) References Cited

U.S. PATENT DOCUMENTS

| | | | | |
|---|---|---|---|---|
| 1,671,285 | A * | 5/1928 | Hanna | 206/445 |
| 2,637,462 | A * | 5/1953 | Becker | 220/800 |
| 3,826,358 | A | 7/1974 | Butler et al. | |
| 4,805,789 | A * | 2/1989 | Lancesseur et al. | 215/6 |
| 4,899,897 | A * | 2/1990 | Buttiker et al. | 215/228 |
| 6,619,494 | B1 * | 9/2003 | Brozell et al. | 215/231 |
| 6,986,807 | B2 * | 1/2006 | Brunk | 96/147 |
| 7,413,083 | B2 * | 8/2008 | Belfance et al. | 206/540 |
| 2005/0016873 | A1 * | 1/2005 | Belfance et al. | 206/204 |
| 2010/0140116 | A1 * | 6/2010 | Stiene et al. | 206/204 |

FOREIGN PATENT DOCUMENTS

| | | |
|---|---|---|
| DE | 8337183 | 1/1986 |
| EP | 1602596 | 12/2005 |
| FR | 2694270 | 2/1994 |
| FR | 2705646 | 12/1994 |

* cited by examiner

*Primary Examiner* — Luan K Bui
*Assistant Examiner* — Rafael Ortiz
(74) *Attorney, Agent, or Firm* — Scott R. Cox

(57) ABSTRACT

A tubular container, closed at its top part by a closure means of the stopper type including with a hinge, for packaging unit products stacked axially or in bulk such as pallets, tablets, cachets or pills, and provided with a compensation device, positioned at the bottom of the container. The container optionally includes a desiccating means and the compensation device includes a compensation means and a fastening means. The fastening means is secured to the compensation means and has a shape memory.

26 Claims, 3 Drawing Sheets

CLOSED TUBULAR CONTAINER COMPRISING A COMPENSATION DEVICE FOR THE PACKAGING OF TABLETS

FIELD OF THE INVENTION

The present invention relates to a tubular container, closed at its top part by a closure means of the reclosable stopper type including with a hinge, provided with a compensation device.

The invention relates more particularly to a container of this type intended in particular for packaging products for pharmaceutical, cosmetic, food, veterinary, diagnostic or plant-health use, able to be in various forms such as for example pellets, pills, cachets and tablets. These packaged products may be stacked axially inside the tubular container, the internal dimensions of the latter corresponding substantially to the external dimensions of the packaged products, or be in bulk inside said container.

DESCRIPTION OF RELATED ART

The packaged products mentioned above often have a porous and friable structure, in particular when they are effervescent tablets, which makes them particularly fragile under impact and abrasion. This mechanical damage is often caused during the handling and transportation of these products packaged in tubes themselves stored in boxes or cartons, during which impacts or jolts are unavoidable.

It has already been proposed to keep said products in position in a tubular container, full or substantially full, by virtue of a compensation device in the form of a spring or spiral. Thus the packaged products may no longer move in an unwanted fashion inside the container during transportation.

In addition, such compensation devices make it possible to compensate for the differences in thickness of the unit products packaged, or to package in the same container products with different thicknesses giving rise to an unavoidable clearance existing between the bottom of the closure means and the top face of the stack of products packaged in the container. Any freedom of movement inside such a space is a possible source of damage to said packaged products.

Four documents reflecting particularly the closest prior art in this field have been selected and are described below. They disclose various solutions for holding packaged products in a tubular container by means of a compensation device.

A first document (US 2005/0016873 A1) describes various embodiments of a desiccating container for storing tablets, of the pharmaceutical type for example. This container comprises in its bottom and/or in its closure means, of the stopper type connected to said container by a hinge, an elastic spring consisting of helical strands intertwining or not, said spring being able to be produced from desiccating polymer material and on which the stacked packaged products bear.

This first document presents a compensation device of the elastic spring type, the latter being fixed either to the bottom of the container or to the internal surface of its closure means by overmoulding, which gives rise to a certain amount of cohesion between materials.

A second document, the document U.S. Pat. No. 1,671,285, describes a tablet-dispensing container, the body of which is closed off at its bottom end by an attached bottom to which a spring provided with a plate is fixed, the stack of stored tablets bearing on said plate. A retaining element at the top end of the container allows unit extraction of the tablet situated on the top of the stack through a lateral opening provided on the top part of the container.

This document thus proposes a compensation device in the form of a spring that also contributes to the extraction of the tablets, because of the relaxation of said spring, and which allows lateral extraction of the tablet situated on the top of the stack. This compensation device is composed of two different parts, namely a spring and a plate.

A third document, the document EP 1 602 596 A2, greatly resembling the document U.S. Pat. No. 1,671,285, also describes a dispensing container for effervescent tablets that rest stacked axially on a perforated disc associated with a spring, the latter being fixed to the perforated top face of a compartment provided at the bottom of the container, and in which a desiccant is inserted. The container described in this document also comprises a screw cap provided with a seal providing a hermetic closure. Finally, a compartment for storing a limited number of tablets, also provided with a desiccating means, and closed off by a stopper at one of its ends, may be screwed by its other end to the bottom base of the container.

This document presents the same compensation device as the document U.S. Pat. No. 1,671,285, i.e. a spring device allowing the extraction of tablets with in addition a few improvements such as the presence of a desiccant and an additional storage compartment.

Finally, a fourth document, the document FR 2 694 270, describes a packaging tube, in particular for pharmaceutical products such as tablets, closed by a stopper, this tube comprising a suspended basket for receiving said tablets and by virtue of which they are protected against impacts. Elastic means are provided so as to automatically compensate for the axial space existing between the top face of the top tablet and the opposite internal face of the stopper. These same elastic means may also be arranged symmetrically in the bottom of the suspended basket. A desiccant may also be inserted at the bottom of the tube.

This document describes a packaging tube equipped with a compensation device where the design of the suspended basket appears complex from the moulding point of view.

In the light of the prior art described above, the compensation devices are often of complex design with regard to their shape. In addition, they are generally produced so as to adapt in an entirely specific manner to the dimensions of a given container, or where applicable to a given stopper, in which they must be inserted.

Thus the production of a compensation device appears to depend on the characteristics, in particular the dimensions, of the container or stopper in which it must be inserted, and gives rise to high manufacturing costs because a single compensation device may be used only for a single given container; these costs being added to those of the production of complex shapes of the compensation device.

SUMMARY OF THE INVENTION

There is therefore a technical problem posed and not resolved, which is that of not being able to produce a compensation device of easy design and being able to adapt to many tubular containers of similar dimensions and diameters when they have a circular cross-section, whilst also providing sufficient protection for the packaged products against impacts and jolts occasioned during transportation and handling.

Another problem posed to the designer is to propose a tubular container equipped with a compensation device in the form of a moulded piece independent of said container and inserted easily and so that it becomes integral with it. The insertion of the compensation device in the tubular container being able to be performed:

before the introduction of the packaged products, or conjointly with these.

Another technical problem often poorly resolved and to be resolved is that of tubular containers closed by a stopper of the hinged type, the opening/closing movement of which is interfered with or even prevented when said stopper is provided with a compensation device; to do so, the height of said compensation device must be reduced, which causes a loss of efficacy of the compensation action.

Consequently the main object consists of producing a tubular container equipped with a compensation device such that:

the latter may adapt to many containers of similar dimensions and diameters when the container has a circular cross-section, its shape, of non-complex design, allows easy and definitive insertion at the bottom of said container, and this before the introduction of the packaged products or conjointly with the latter, its position at the bottom of said container leaves entire freedom for the choice of the type of closure means, including of the hinged type.

Consequently the invention concerns a tubular container closed at its top end by a closure means of the stopper type including with a hinge, for packaging unit products stacked axially or in bulk such as pellets, tablets, cachets or pills, and provided with a compensation device, positioned at the bottom of said container, said container optionally comprising a desiccating means, said compensation device consisting of:

a compensation means provided at its ends with a large base and a small base that is at most equal to the large base, and on one of which the packaged products rest, and a fastening means, which is characterised in that said fastening means:

is secured to the compensation means, and is composed of mechanical elements, with a shape memory which, after their elastic deformation following the insertion of said compensation device in the bottom of the container, make the compensation device integral with the container by exerting on the internal lateral wall of the container a friction force perpendicular to said wall.

DETAILED DESCRIPTION OF THE INVENTION

The tubular container according to the invention is intended for the packaging of solid products, stored inside said container in the form of an axial stack or in bulk. The container according to the invention may be used for the packaging of products for pharmaceutical, cosmetic, food, veterinary, diagnostic or plant-health use.

When the stacking of packaged products is axial, the internal dimensions of the tubular container corresponds substantially to the external dimensions of said packaged products. The axial stacking of packaged products is preferred to heaping in bulk.

Advantageously, the tubular container may be polygonal, elliptical or circular in cross-section and is preferably circular in cross-section.

Such packaged unit products such as pellets or pills may be friable so that holding them is essential in order to avoid any risk of damage by mechanical effect, in particular impact or abrasion.

The tubular container is closed at its top part by a closure means of the reclosable stopper type, including with a hinge, so that, when said container is full or almost full, the compensation device with which the container is provided exerts its compensation action on the packaged products and holds them in position, thus preventing any risk of damage.

The Compensation Device

The tubular container according to the invention is provided with a compensation device, positioned at the bottom of said container, and consisting of:

a compensation means a fastening means

The compensation means and the fastening means are secured to each other.

The fastening means is secured to the compensation means by adhesive bonding, welding, co-injection or injection leading to a single-piece assembly. The compensation means and the fastening means are coaxial.

The Compensation Means

The compensation means of the compensation device is hollow and of apparent cylindrical, conical, frustoconical, polyhedral or truncated polyhedral shape, composed of a large base and a small base parallel to the large base. Indifferently the small base or the large base is in contact with the packaged products; the large base or the small base then being in contact with the bottom of the container. The fastening means is always secured to the base in contact with the bottom of the container, whether this be the large base or the small base. These two bases are coaxial and are connected by at least one connection means deformable under the effects of a mechanical pressure, and which has the capacity to recover its initial shape when said pressure is removed.

The large base and the small base of the compensation means may have different shapes or not, but in all cases these different shapes must be able to be inserted in the tubular container and adapted to the cross-section of said container.

In a particular embodiment, said cross-section of the container is polygonal, elliptical or circular.

The compensation means is of sufficient height for its mechanical compensation action to be exerted effectively. Thus, when the container according to the invention is full or almost full with packaged products and closed by its closure means, the compensation means exerts its compensation action on the packaged products, so that they are held in position inside said container.

The apparent shape of the compensation means, i.e. the notional volume in which said compensation means is contained, that is to say its steric hindrance, may be cylindrical, conical, frustoconical, polyhedral or truncated polyhedral.

The deformable means of connecting the large base to the small base may be formed by:

at least one deformable helix coiled on a cylinder or notional cone and coaxial with the axis of symmetry of the compensation means, and appearing as a cylindrical frustoconical or conical spring, or at least one deformable tongue appearing as one of the edges of the faces of the notional polyhedron in which the compensation means fits or belonging to the notional surface of a cone or truncated cone.

The compensation means, when contained in a cylindrical, conical, frustoconical, polyhedral or truncated polyhedral notional volume may comprise several deformable connection means, 2, 3, 4 or more in number and disposed around the axis of symmetry of the compensation means.

In particular, when the notional volume is polyhedral or truncated polyhedral, one of the edges is formed by the at least one real deformable connection means, connecting the large base to the small base, the other edges being notional.

For illustration purposes, when the notional volume is polyhedral or truncated polyhedral, it comprises at a minimum three lateral surfaces, the three real edges of which are formed by three deformable connection means. The same applies for 4 faces, 5 faces or 6 faces.

When the at least one deformable connection means is formed by at least two helixes, said helixes are in opposite directions or not and regularly distributed symmetrically with respect to the axis of symmetry of the compensation means.

In the case where, for example, the compensation means comprises three helixes, these helixes may be in the same direction or two helixes may be in the same direction and the third helix in the other direction.

This at least one helix is connected, by its bottom end, to one of the bases, which is positioned for example in the bottom of the container. This at least one helix also connected, by its top end, to the other base for example in physical contact with the packaged product.

The cross-section of this at least one helix may be circular or polygonal.

Other forms of helixes may be considered such as for example helixes with opposite directions of rotation or with a form not strictly conical but slightly rhomboid.

When the at least one deformable connection means is formed by at least two tongues, said tongues are distributed symmetrically with respect to the axis of symmetry of the compensation means. This at least one tongue is connected, by its bottom end, to one of the bases, for example the large base, which is positioned for example at the bottom of the container, and by its top end to the other base in physical contact with the packaged product.

Said compensation means thus provides, by its capacity for being compressed and by its spring effect, the holding in position of the packaged product. The cross-section of the tongues is sufficiently thin, whether they be circular or polygonal, for said tongues to be able to deform reversibly, under the effect of the pressure exerted on them when the filled container is closed.

The spring effect remains entire over time, since the deformations remain in the range of reversible elastic deformations and there is no creep of the materials making up the compensation means. The pressure exerted on the stack of products packaged by the compensation means remains unchanged.

The compensation means, with its apparent conical or polyhedral shape, deformable but with an initial shape memory, always keeps its function as a compensator with spring effect.

The Fastening Means

The compensation device also comprises a fastening means.

The fastening means of the compensation device with shape memory and having an elastic deformation capacity exerts a friction force perpendicular to the internal lateral wall of the container and to do this is formed from mechanical elements, said mechanical elements may in particular be chosen from the group consisting of fins, panels and blades.

The fastening means comprises at least three mechanical elements. The at least three mechanical elements of the fastening means are secured to the compensation means tangentially to the periphery of the base in contact with the bottom of the container of said compensation means and distributed symmetrically with respect to the axis of symmetry of the compensation device, so that all the friction forces that they generate with the internal lateral wall of the container secure the compensation device to the tubular container.

Thus, very advantageously, once the compensation device is positioned at the bottom of the container, said container may be turned over without the compensation device escaping from it.

The at least three mechanical elements of the fastening means, at rest and before they are inserted in the container, define by their end not secured to the compensation means an apparent outline, the largest dimension of which, defined by the greatest distance between two points in opposition on said outline, is between 1.1 and 2.0 times the largest dimension measured in the cross-section plane perpendicular to the longitudinal axis of symmetry of the container.

Where the cross-section of the container is polygonal, the largest apparent dimension is:

for an equilateral-triangular cross-section, one of the sides of the triangle, for a square cross-section, a diagonal, for a rectangular section the longest diagonal, and this step by step for any polygonal cross-section.

Where the cross-section is elliptical, the largest apparent dimension is the longest elliptical axis.

Where the cross-section is circular, the largest apparent dimension is the diameter.

The at least three mechanical elements of the fastening means, at rest and before they are inserted in the container, define by their end not secured to the compensation means an apparent outline, the largest dimension of which, defined by the greatest distance between two points in opposition on said outline, is preferentially between 1.2 and 1.6 times the largest dimension measured in the cross-section plane perpendicular to the longitudinal axis of symmetry of the container.

The at least three mechanical elements of the fastening means have a height, when the compensation device is inserted in the container, of no more than 0.5 times the height of the compensation means.

The at least three mechanical elements of the fastening means are thin walls forming planar or curved surfaces.

Thus, once the compensation device is positioned at the bottom of the tubular container, the at least three elastic mechanical elements being redeployed until they are in surface to surface contact with the internal lateral wall of the container, exert friction forces on said internal lateral wall, which ensures a holding in position of said compensation device in the tubular container.

Further to the advantage mentioned above of reliability of holding this compensation device in position at the bottom of the container, and this even in the absence of the closure means and/or of the packaged products, the other advantageous features of this compensation device should be noted.

The at least three mechanical elements of the fastening means may optionally each comprise a protuberance having the form of a segment of rods coming to fit in a corresponding groove positioned on the internal surface of the container. This association of segments of rods and groove makes it possible to fasten the compensation device inserted in the container in an even more definitive manner.

First of all, the compensation device may be introduced before the packaged products in the container, or conjointly with the packaged products.

Thus the succession of the steps of handling the container equipped with this compensation device according to the invention is simplified.

In addition, because of the elasticity of the at least three mechanical elements constituting the means of fastening the compensation device, this compensation device may be adapted to tubular containers of similar dimensions and diameters when the container has a circular cross-section.

Thus this compensation device may be integrated in various containers, providing flexibility in use, and making it possible to be free of the constraint of producing a compensation device particular to each type of container.

All these advantages mentioned above make it possible to limit the manufacturing costs of containers provided with this compensation device.

The Polymer Materials

In general terms, the container, the closure means and the compensation device may be produced from identical or different polymers.

The polymers used are generally selected from the group consisting of polyolefins, homo- and/or copolymers such as polyethylenes, polypropylenes, and ethylene/propylene copolymers used alone or in a mixture, formulated or not.

Other thermoplastic polymers may also be used such as polyamides (PA), polystyrenes (PS), acrylonitrile-butadiene-styrene copolymers (ABS), styrene-acrylonitrile copolymers (SAN), polymethylmethacrylates (PMMA), polyethyleneterephthalates (PET), polybutyleneterephthalates (PBT), polyacetals (POM), polyvinyl chlorides (PVC) and polycarbonates (PC).

Elastomers of mono-olefins such as for example polymers of isobutylene/isoprene, ethylene vinyl acetate (EVA), ethylene-propylene (EPR), ethylene-propylene-diene (EPDM), acrylic ethylene-esters (EMA-EEA), fluorinated polymers, diolefin rubbers, such as for example polybutadiene, butadiene-styrene copolymers (SBR), rubbers based on condensation products such as for example polyester and polyurethane thermoplastic rubbers, silicones, styrene rubbers, such as styrene-butadiene-styrene (SBS), styrene-isoprene-styrene (SIS), styrene-ethylene butadiene-styrene (SEBS) and other block copolymers, and more generally thermoplastic elastomers, used alone or in a mixture, with in particular the aforementioned thermoplastic polymers, formulated or not, may also be used.

Thus the compensation device described in the present invention simplifies the manufacturing and design of tubular containers for packaging fragile products, such as pharmaceutical tablets, whilst fulfilling the function of holding in position inside said container.

The Desiccant Means

The tubular container according to the invention optionally comprises a desiccant means, which may be of the attached type or of the desiccating jacketing type.

According to another embodiment of the invention, the compensation device may also constitute a means of desiccating the tubular container, if it is manufactured from a composition comprising at least one thermoplastic or thermosetting plastic material, and at least one desiccating material.

When the desiccant means is of the attached type, the desiccant is placed in an appropriate housing, situated in the stopper, and/or on the bottom of the tubular container, and/or integrated in the compensation device, or form an integral part of said device, said housing being closed by a closure means not tight to ambient moisture, for example a membrane made from porous cardboard, in order to provide the rapid desiccation of the moisture-sensitive products packaged in the tubular container.

The desiccant used in the container is selected from the group consisting of silica gels, molecular sieves and other desiccants, in a powder form or deposited on a powdery support.

The desiccant may also be a capsule contained in said housing and produced from a desiccating polymer material containing or not desiccating fillers.

When a desiccant is positioned in a housing situated on the bottom of the tubular container, the compensation device is positioned in abutment on the membrane not tight to ambient moisture closing the housing.

When the desiccating means is of the jacketing type, it then has a form such that it comes to fit inside the tubular container. This form is positioned coaxially with respect to the container, adjusted very precisely with respect to the internal surface of said container and able to slide freely with respect to it, or be lightly force-fitted. This form may also be slightly recessed from the internal surface of the tubular container, the fitting on the container then taking place through a plurality of longitudinal ribs parallel to the axis of the container, and providing the centring, or optionally by means of protuberances, corresponding to truncated ribs.

Such a jacketing may have a dimension in height identical to the depth of the tubular container and come to fit flush with the open end of said container or have a smaller dimension.

The jacketing may also have a bottom, coming or not to be placed on the bottom of the tubular container. A spacing wedge may also leave a space between the bottom of the container and the bottom of the jacket constituting the desiccant means.

This desiccant jacket is manufactured by injection techniques using desiccating compositions. These desiccating compositions are generally well known and are amply described in the form of injectable thermoplastic compositions comprising polymer materials in which desiccants have been incorporated.

When the desiccating means is of the jacketing type, the fastening means of the compensation device exerts friction forces on the desiccating jacket.

In the embodiment of the invention for which the compensation device is also a desiccating means, said desiccating means is produced with the same polymers and desiccating materials as those used for producing the desiccating jacket.

The invention will be better understood by means of the numbered description of the figures mentioned below, these figures having only a non-limitative character illustrative of a particular device of the invention.

DESCRIPTION OF THE PREFERRED EMBODIMENTS

Figure 1:
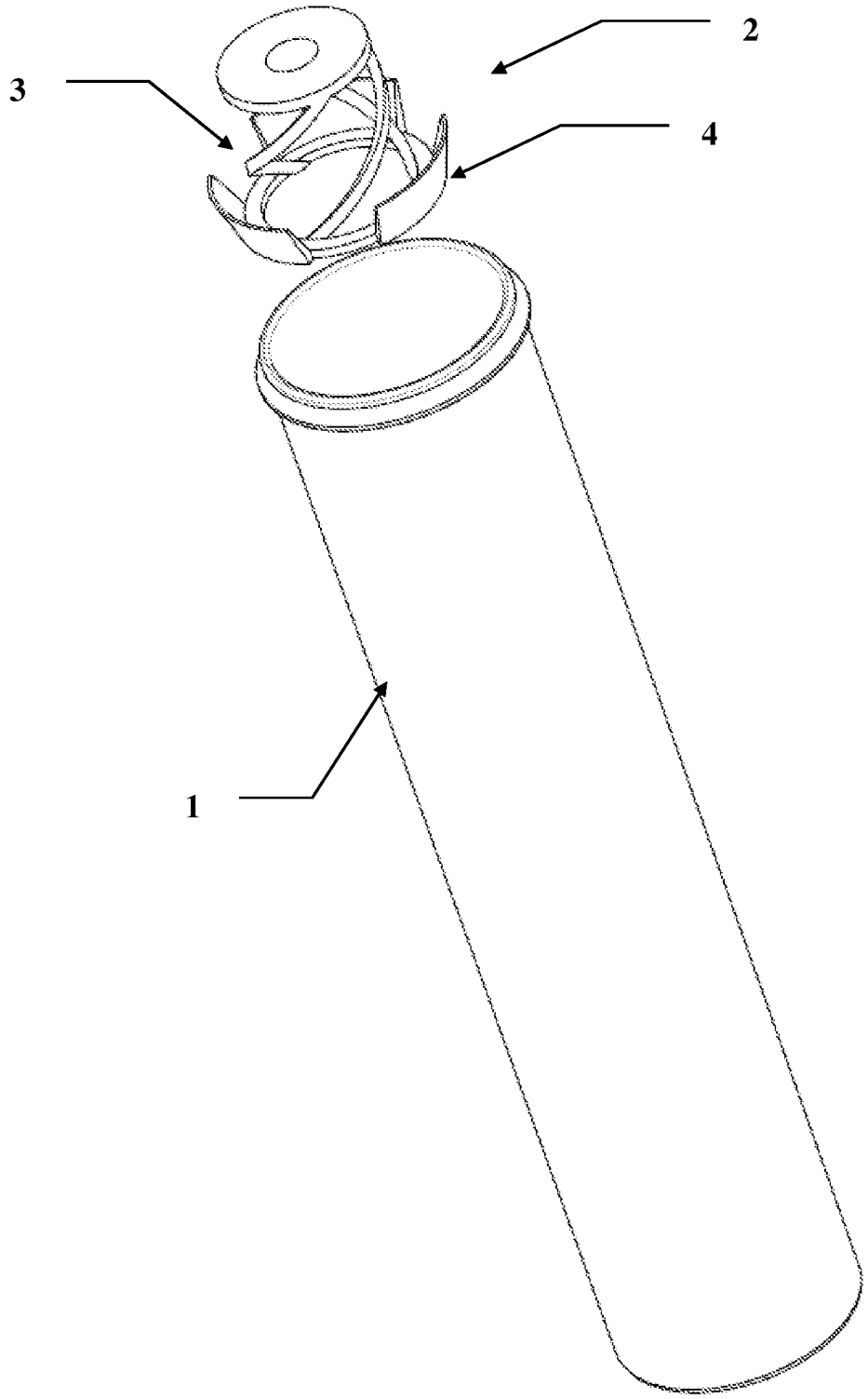
FIG. 1 depicts a perspective view of the tubular container and of the compensation device according to the invention before its insertion. The tubular container is cylindrical.

FIG. 1 shows the tubular container (1) with its compensation device (2) not yet inserted, but without its closure means. The compensation device consists of a compensation means (3) and a fastening means (4).

Figure 2:
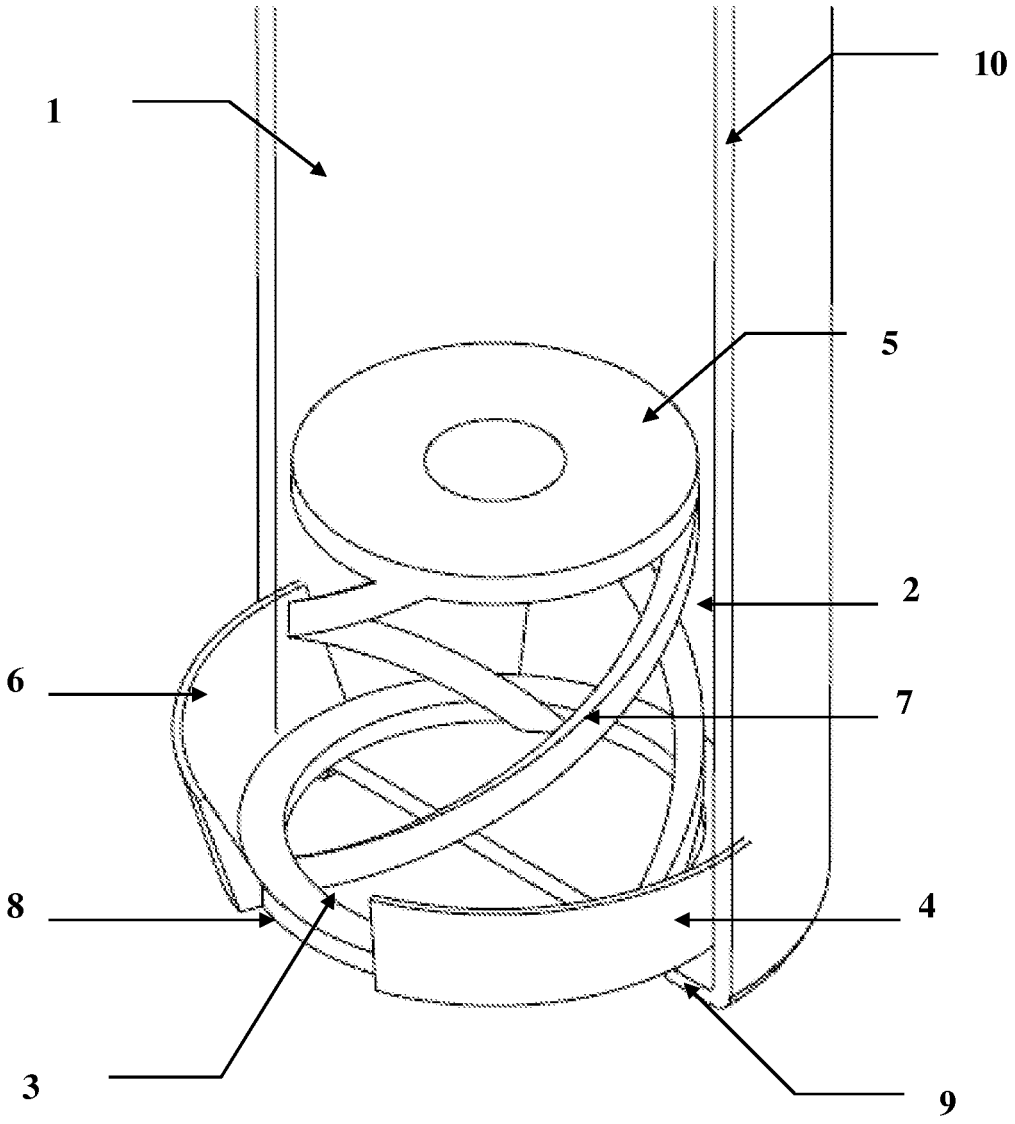
FIG. 2 is a perspective view of half of the container along a vertical section and truncated at its top part comprising the compensation device according to the invention inserted at the bottom of the container.

FIG. 2 shows the compensation device (2) inserted at the bottom (9) of the container (1) empty of its content. The compensation device (2) consists of a compensation means (3) and a fastening means (4).

The compensation means (3) is hollow and of apparent conical shape, composed of a circular large base (8) inserted at the bottom (9) of the container (1) and a circular small base (5) on which the packaged products rest (not shown in the present figure). The two bases of the compensation means are coaxial and connected by deformable connection means (7) that have the form of helical strands.

The fastening means (4) consist of three mechanical elements (6) that are in the form of fins.

Figure 3:
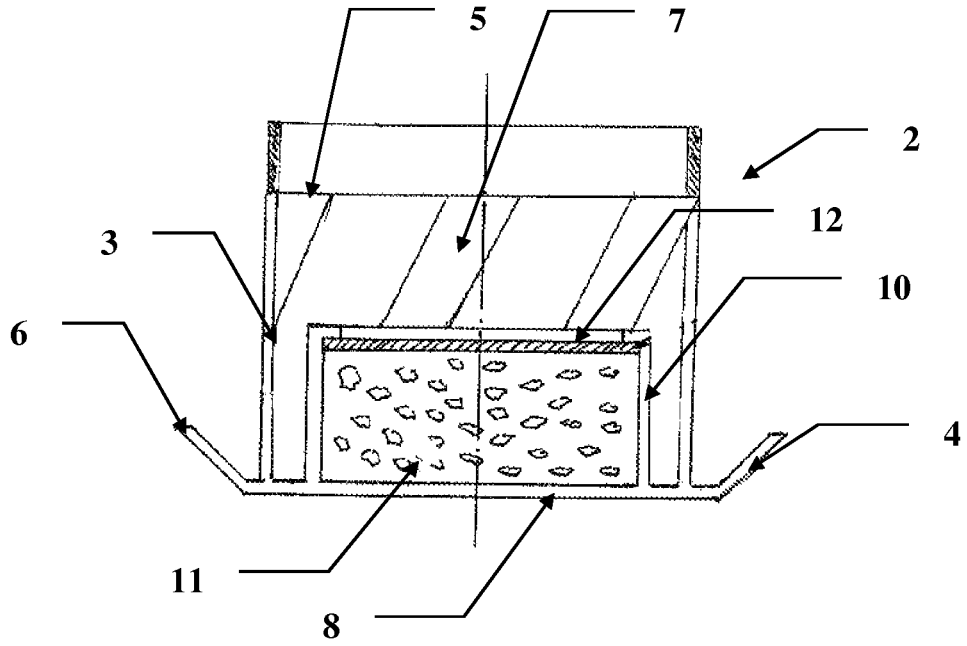
FIG. 3 is a view in section of the compensation device according to the invention, in an alternative container equipped with a housing containing a desiccant integrated in said device.

FIG. 3 depicts a variant of the compensation device (2) comprising a compensation means (3) and a fastening means (4), and a housing (10) constituting an integral part of the device and allowing the use of a desiccating material (11).

The compensation means (3) is hollow and of apparent cylindrical shape, composed of a circular large base (8) inserted at the bottom of the container (not shown) and a circular small base (5). The two bases of the compensation means (3) are coaxial and connected by the deformable connection means (7) that are in the form of helical strands.

The fastening means (4) consist of mechanical elements (6) that are in the form of fins. The housing (10) forms an integral part of the device (2), the bottom of the housing (10) being part of the large base (8), the cylindrical lateral walls of the housing (10) having a diameter such that the compensation means (3) may freely fulfil its function. A porous membrane (12) held by crimping that makes it possible to hold the desiccant (11) in position.

What is claimed is:

1. Tubular container closed at a top end thereof by a removable closure means, and provided with a compensation device, positioned within the container at a bottom end of said container, the bottom end being opposite to said top end, the top end and the bottom end defining therebetween a single space for packaging unit products stacked axially or in bulk, wherein the bottom end is a closed end of the container, said compensation device comprising:

a compensation means provided at one end with a first base resting on the bottom of the container and a second base, opposite to the first base and oriented toward the top end on which the packaged products added through the top end rest, and a fastening means, characterized in that said fastening means:

is secured to the first base of the compensation means, and comprises mechanical elements with a shape memory which, after an elastic deformation thereof resulting from insertion of said compensation device in the bottom end of the container, secures the compensation device within the container by exerting on an internal lateral wall of the container a friction force perpendicular to said wall, wherein the first base is ring-shaped, and the second base is designed so that the second base is movable into the ring-shaped first base.

2. Container according to claim 1, wherein the fastening means exerting a friction force perpendicular to said internal lateral wall of the container is formed from at least one mechanical element selected from the group consisting of fins, panels and blades.

3. Container according to claim 1, wherein the fastening means comprises at least three mechanical elements.

4. Container according to claim 1, wherein the fastening means is secured to the compensation means by adhesive bonding, welding, co-injection or injection leading to a single-piece assembly.

5. Container according to claim 3, wherein the at least three mechanical elements of the fastening means, at rest and before insertion in the container, define by an end thereof not secured to the compensation means, an apparent outline, the largest dimension of which, defined by the greatest distance between two points in opposition on said outline, is between 1.1 and 2.0 times the largest dimension measured in the cross-section plane perpendicular to a longitudinal axis of symmetry of the container.

6. Container according to claim 5, wherein the greatest distance between two points in opposition on said outline, is between 1.2 and 1.6 times the largest dimension measure in the cross-section plane perpendicular to the longitudinal axis of symmetry of the container.

7. Container according to claim 3, wherein the at least three mechanical elements of the fastening means have a height, when the compensation device is inserted in the container, of no more than 0.5 times the height of the compensation means.

8. Container according to claim 3, wherein the at least three mechanical elements of the fastening means are secured to the compensation means tangentially to the periphery of the base in contact with the bottom of the container and distributed symmetrically with respect to an axis of symmetry of the compensation device.

9. Container according to claim 3, wherein the at least three mechanical elements of the fastening means are thin walls forming planar or curved surfaces.

10. Container according to claim 3, wherein the at least three mechanical elements of the fastening means each comprise a protuberance in the form of a segment of rods fitting in a corresponding groove positioned on an internal surface of the container.

11. Container according to claim 1, wherein the compensation means is hollow, of apparent cylindrical, conical, frustoconical, polyhedral or truncated polyhedral shape, the first base being in contact with the bottom end of the container, each of the two bases being connected by at least one connection means deformable under the effect of a mechanical pressure and having the capacity to recover an initial shape when said pressure is removed.

12. Container according to claim 1, wherein the large base and the small base of the compensation means have a shape adapted to a cross-section of said container.

13. Container according to claim 11, wherein the at least one deformable connection means of the compensation means is formed by at least one deformable helix wound on a notional cylinder or cone and coaxial with an axis of symmetry of the compensation means and appearing as a cylindrical, frustoconical or conical spring.

14. Container according to claim 13, wherein the at least one deformable connection means of the compensation means is formed by at least two helixes, in opposite directions or not, regularly distributed symmetrically with respect to the axis of symmetry of the compensation means.

15. Container according to claim 11, wherein the at least one connection means of the compensation means is formed by at least one deformable tongue appearing as an edge of a face of a notional polyhedron in which the compensation means fits or belonging to a notional surface of a cylinder, cone or truncated cone.

16. Container according to claim 15, wherein the at least one deformable connection means of the compensation means is formed from at least two tongues distributed symmetrically with respect to an axis of symmetry of the compensation means.

17. Container according to claim 1, wherein the container, the closure means and the compensation device are produced from polymer materials comprising homo-and/or copolymers.

18. Container according to claim 17, wherein the container, the closure means and the compensation device additionally comprise at least one elastomer selected from the group consisting of mono-olefins, ethylene vinyl acetate (EVA), ethylene-propylene (EPR), ethylene-propylene- diene (EPDM), acrylic ethylene-esters (EMA-EEA), fluorinated polymers, diolefin rubbers,-butadiene-styrene copolymers (SBR), rubbers based on condensation products, thermoplastic rubbers, silicones, styrene rubbers, said at least one elastomer being used alone or in a mixture, formulated or not.

19. Container according to claim 1, additionally comprising a desiccating means.

20. Container according to claim 19, wherein the desiccating means is of the attached type, and the desiccant is selected from the group consisting of silica gels, molecular sieves and other desiccating products in a powder form or deposited on a powder support, said desiccant being disposed in an appropriate housing situated in the closure and/or on the bottom of the tubular container, and/or in an appropriate housing secured to or integrated in the device, this housing being closed by a closure means not impervious to ambient moisture.

21. Container according to claim 1, wherein the compensation device is manufactured from a composition comprising at least one thermoplastic or thermosetting plastics material, and at least one desiccating material.

22. Container according to claim 17, wherein the homo- and/or copolymers are selected from the group consisting of polyethylenes, polypropylenes, ethylene/propylene copolymers used alone or in a mixture, formulated or not, polyamides (PA), polystyrenes (PS), acrylonitrile-butadiene-styrene copolymers (ABS), styrene-acrylonitrile copolymers (SAN), polymethylmethacrylates (PMMA), polyethyleneterephthalates (PET), polybutyleneterephthalates (PBT), polyacetals (POM), polyvinyl chlorides (PVC) and polycarbonates (PC).

23. Container according to claim 18, wherein:

the mono-olefins are selected from the group consisting of polymers of isobutylene/isoprene, the diolefin rubbers is polybutadiene, the rubbers based on condensation products are a polyester or a polyurethane, and the styrene rubbers are selected from the group consisting of styrene-butadiene-styrene (SBS), styrene-isoprene-styrene (SIS), and styrene-ethylene butadiene-styrene (SEBS).

24. Container according to claim 1, wherein the fastening means is secured to the base in contact with the bottom of the container.

25. Container according to claim 1, wherein the first base of the compensation means is ring-shaped and is fixed at the bottom end of the container.

26. Container according to claim 1, wherein both the first base and the second base of the compensation means are able to serve as a platform for products resting thereon.

* * * * *